United States Patent [19]

de Brito

[11] 4,023,287

[45] May 17, 1977

[54] PLOW ATTACHMENT FOR SNOW BLOWER

[76] Inventor: William A. de Brito, 27 Heron Road, East Hartford, Conn. 06118

[22] Filed: Mar. 15, 1976

[21] Appl. No.: 666,668

[52] U.S. Cl. ..... 37/43 R; 37/53

[51] Int. Cl.[2] ..... E01H 5/00

[58] Field of Search ..... 37/41, 43 R, 43 D, 43 E, 37/43 L, 50, DIG. 3, 53

[56] References Cited

UNITED STATES PATENTS

| | | | |
|---|---|---|---|
| 1,519,897 | 12/1924 | Asplund | 37/43 E X |
| 2,198,237 | 4/1940 | Voorderman | 37/43 D |
| 2,967,363 | 1/1961 | Meier | 37/53 |
| 3,353,287 | 11/1967 | King | 37/50 X |

FOREIGN PATENTS OR APPLICATIONS

| | | | |
|---|---|---|---|
| 296,136 | 5/1965 | Netherlands | 37/50 |

*Primary Examiner*—E. H. Eickholt

[57] ABSTRACT

A plow attachment for a snow blower may be pivoted between work and storage positions, about a horizontal axis located rearwardly of the snow blower blade, and may be angularly adjusted about a vertical axis. The plow attachment includes a frame and a blade which may be readily connected to and removed from the frame.

8 Claims, 7 Drawing Figures

PLOW ATTACHMENT FOR SNOW BLOWER

BACKGROUND OF THE INVENTION

1. Field of the Invention

The present invention relates to snow removal. More specifically, this invention is directed to a combination snow throwing and plowing apparatus and particularly to a plow attachment for a snow blower. Accordingly, the general objects of the present invention are to provide novel and improved methods and apparatus of such character.

2. Description of the Prior Art

In recent years, in those geographical regions where climatic conditions so warrant, the use of motor driven equipment for assistance in snow removal has extended to the individual homeowner. Such snow removal equipment will usually take the form of a rotating spiral blade, driven by a small gasoline engine, which forces the snow into a chute with sufficient force to cause it to be thrown a significant distance in a direction determined by the aiming of the chute. Such equipment is commonly known as a snow blower. The most commonly used snow blower is of the type provided with a pair of drive wheels with the driving motor situated over the axle interconnecting these wheels. The blade is situated forward of the wheels and connected to the drive motor via a belt. In use, the operator stands to the rear of the apparatus and, via suitable controls, adjusts the speed of the rotor and the discharge direction of the chute while steering the blower with a pair of rearwardly extending handles.

Snow blowers are designed to facilitate the removal of comparatively deep and also dry snow. Thus, for light snowfalls it is usually quicker and easier to employ a shovel to clear the area of interest. This results in a comparatively expensive appliance being use, in many sections of the United States, subsequent to perhaps only one-half of the annual snowfalls. For snow of a wet consistency, there is a tendency for the snow to stick to the sides of and thus clog the discharge chute of a snow blower thus rendering the apparatus useless. Additonally, in view of the force with which the snow is expelled from the discharge end of the chute, use of a snow blower can result in damage to valuable shrubbery as well as glass such as automobile and building windows. Thus, it is quite common for the owner of a snow blower to nevertheless resort to partial shoveling of the area to be cleared due to the lack of a suitable direction in which the snow blower discharge chute may be aimed.

As an alternative to the use of a snow blower, it is of course possible to employ a fixed position blade to plow the area which is to be freed from its snow cover. For most homeowners, however, a plow embodies disadvantages which far outweigh those discussed above which are incident to the use of a snow blower. Thus, by way of example, use of a plow customarily leaves large piles of snow which have to be removed by shoveling. Also, with heavy wet snow, a plow of the size which would be economically practical for the homeowner would be unable to obtain sufficient traction to remove a significant amount of the snow.

There is equipment available to the homeowner, primarily in the form of attachments to small tractors, which would permit an individual to have available both a snow blower and a plow. However, in use it would be necessary to perform the time consuming and difficult task of removing one attachment from the tractor and attaching the other whenever conditions warranted a change in the mode of snow removal. Thus, there has not previously been an appliance, suitable for home or individual use, which combined the attributes of both a snowplow and a snow blower.

SUMMARY OF THE INVENTION

The present invention overcomes the above briefly discussed and other deficiences and disadvantages of the prior art by providing a combination snowplow and snow blower. Thus, in accordance with the present invention, a plow attachment is provided for a snow blower. The plow attachment of the present invention is characterized by semi-permanent mounting on the snow blower whereby it may be merely pivoted between a raised position and the operative position. Thus, no assembly operations are required to switch from a snow plowing to snow blowing operational mode and vice versa. The plow attachment of the present invention is also characterized by ease of disassembly from the snow blower and the ability to position the blade at any one of several angles with respect to the direction of motion of the apparatus.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
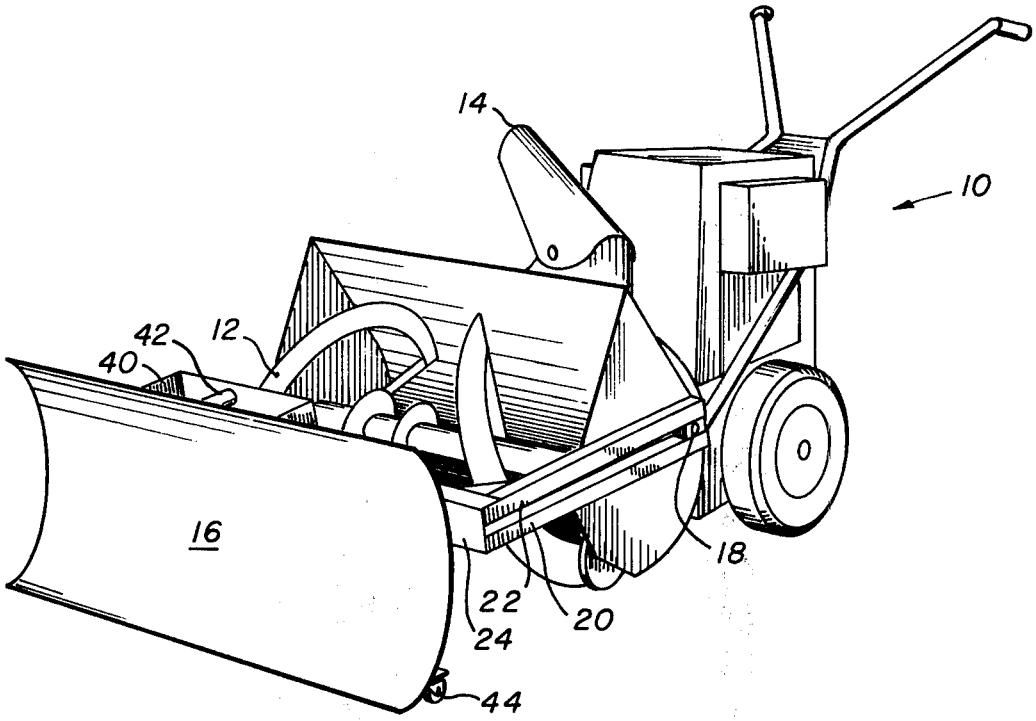
FIG. 1 is a perspective view of a snow blower with the plow attachment of a preferred embodiment of the present invention in the operative position.
Figure 2:
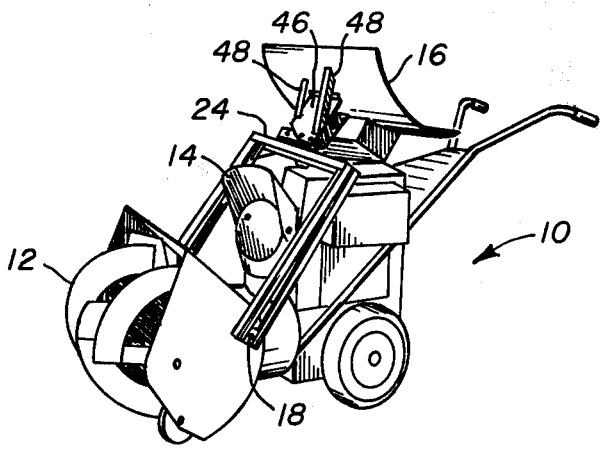
FIG. 2 is a perspective view, on a reduced scale, of a snow blower with the plow attachment of the preferred embodiment of the present invention in the raised position.

With reference now to the drawing, and particularly FIGS. 1 and 2, a conventional snow blower is indicated generally at 10. Snow blower 10 is of the type behind which the operator will walk and includes a shielded rotary blade 12 which delivers snow to a discharge chute 14 in the known manner. The snow blower 10 is driven by a gasoline engine mounted in a housing positioned above and supported on the axle which interconnects the drive wheels. The motor is coupled to the drive wheels and to the rotating blade by any suitable means such as, for example, drive belts. The snow blower is provided with clutch mechanisms whereby the blade drive and wheel drive may be disengaged.

Figure 3:
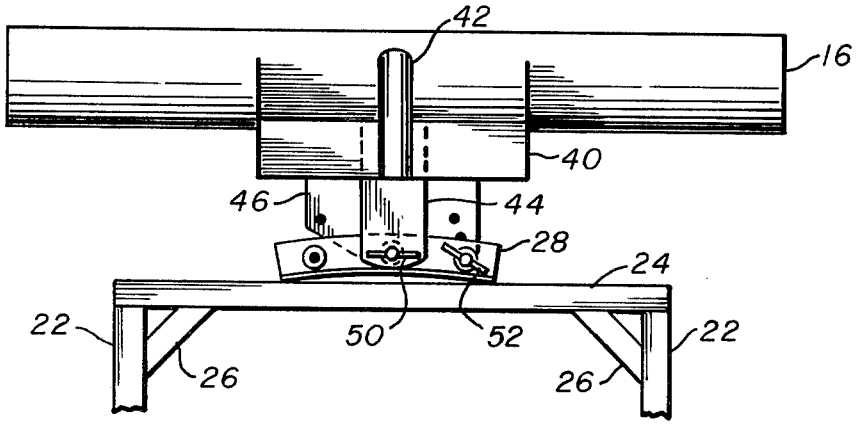
FIG. 3 is a top plan view of a portion of the plow attachment of FIGS. 1 and 2.
Figure 4:
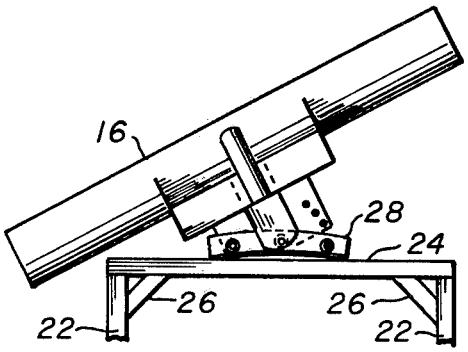
FIGS. 4 and 5 are top plan views, on a reduced scale with respect to FIG. 3, of the plow attachment of FIGS. 1 and 2 depicting the angular adjustment of the blade.
Figure 5:
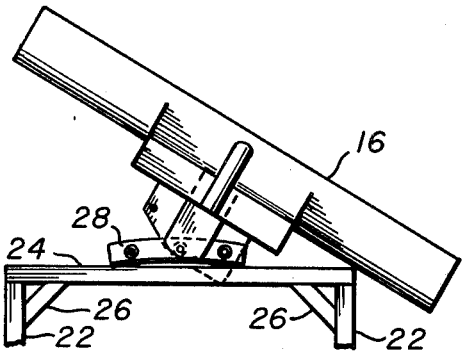

The plow attachment of the present invention includes an angularly adjustable blade 16 mounted for vertical pivoting about an angle of approximately 120°. Blade 16 is removably attached, in the manner to be described below, to a frame. This frame, in turn, is pivotally mounted to the shield for blade 12 of the snow blower via a pair of shoulder bolts; one of such bolts being indicated at 18 on FIGS. 1 and 2. The side members of the plow attachment frame, in the disclosed embodiment, are defined by pairs of generally parallel channel angle "irons" 20 and 22. These angle irons are welded, at a first end, to plates through which the shoulder bolts 18 pass. At their opposite or forward ends the pairs of frame members 20 and 22 are received in and welded to a transversely oriented channel defining member 24. As may best be seen from FIGS. 3–5, angularly oriented braces 26 are welded to the side and transverse front members of the frame in the interest of imparting strength and rigidity to the frame. If necessary to afford suitable clearance to permit the frame to be swung upwardly from the position shown in FIG. 1 to that of FIG. 2, the sides of the frame may be bowed outwardly. As previously noted, and as will be discussed in detail below, the blade 16 is mounted from the front member 24 of the frame. As also previously noted, the frame as defined by the pairs of substantially parallel side members and the front member 24, with or without the blade 16 attached thereto, may be pivoted about an axis defined by the location of shoulder bolts 18.

Referring to FIGS. 3–7, an arcuate blade receiving member 28 is welded to the frame front member 24. Arcuate member 28, in the disclosed embodiment, is itself of angle type configuration. Member 28, as may best be seen from a joint consideration of FIGS. 3 and 7, will be provided in its forwardly extending horizontal portion with three holes. Tubular guide or extension members are welded to arcuate member 28 in registration with these three holes as indicated at 30, 32 and 34 in FIG. 7. The tubular members 30 and 34 situated adjacent the side edges of member 28 are of equal length and are shorter than the intermediate tubular extension member 32. The tubular extensions 30, 32 and 34 are also provided, in their side surfaces as may be seen from FIGS. 6 and 7, with threaded transversely oriented holes which intersect the longitudinal passage through the tubular members. These threaded holes receive threaded locking pins such as pins 36 and 38 of FIGS. 6 and 7.

The plow blade 16 is provided, on its rearwardly disposed surface with an open topped box defining member 40. This open topped box 40 may best be seen from a joint consideration of FIGS. 1 and 3. The box 40 is reinforced by means of a tubular member 42 welded to the back of the blade at one end and to the back of the box 40 at its other end. The open topped box 40 receives, when necessary, suitable material to weigh down blade 16. Depending on the circumstances, the box 40 may be merely filled with sand or lead weights may be placed therein. At its bottom edge, in the known manner, blade 16 may be provided with either skids or rollers. A single such roller has been indicated only in FIG. 1 at 44 as exemplary of the manner by which movement of the blade along the surface to be cleared may be facilitated. The roller 44 or a skid will typically be adjustable in height so that the ground-to-blade clearance may be selected as dictated by the smoothness of the surface to be cleared.

An upper blade mounting plate 44 is welded to the bottom of box 40 and extends rearwardly therefrom. Upper mounting plate 44 is provided with a single aperture therein. A lower blade mounting plate 46, which may best be seen from FIG. 2, is also welded at one end to the back of blade 16 and extends rearwardly therefrom. As may best be seen from joint consideration of FIGS. 2–5, lower mounting plate 46 has an irregular shape and is provided with a pattern of holes; there being five holes in the disclosed embodiment. Looking down from the top of the attachment, a first of the holes in plate 46 is positioned so as to be capable of being brought into registration with the tubular extension 30 on plate 28 while the three holes of a hole array in mounting plate 46 may be individually brought into registration with the tubular extension 34 welded to arcuate plate 28. The center hole in lower mounting plate 46 is in registration with the hole in upper mounting plate 44 and these two holes, with the blade attached to the pivotal frame, in registration with a center hole in arcuate plate 28 and the tubular extension 32 thereof. Referring again to FIG. 2, a pair of L-shaped brackets are welded to the back of blade 16, below the point of attachment of the lower mounting plate 46, and extend angularly upwardly to plate 46 and are welded thereto. The rigidizing members have been indicated at 48.

Figure 6:
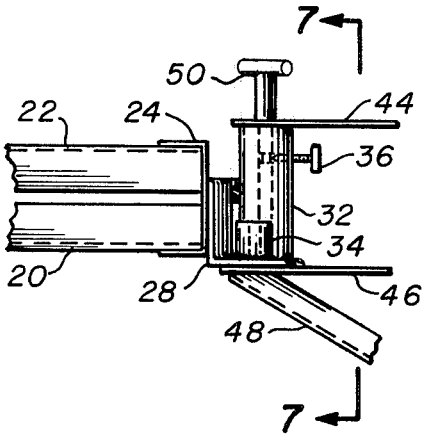
FIG. 6 is a side elevation view of the means by which the plow blade of the disclosed embodiment of the present invention is connected to the remainder of the attachment.
Figure 7:
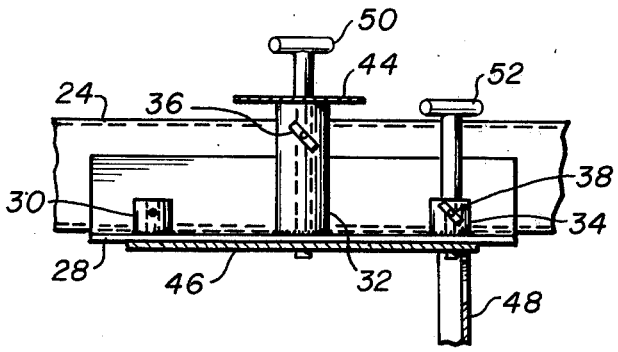
FIG. 7 is a front elevation view, taken along line 7—7 of FIG. 6, of a portion of a preferred embodiment of the present invention.

The frame, including the side and front members 20–24 and the arcuate blade receiving plate 28, will customarily remain on the snow blower at all times and, when it is desired to use the device only as a snow blower, the frame will be pivoted upwardly to the position shown in FIG. 2. In order to attach the blade 16 to the frame, the frame is pivoted downwardly and the snow blower positioned behind the blade whereby the center holes in the upper and lower blade mounting plates 44 and 46 will be in alignment with the center hole in arcuate plate 28 and its tubular extension 32. With these holes in registration, a pin 50 will be dropped into position as shown in FIGS. 6 and 7 thus pivotally affixing the blade to the frame. Pin 50 will, as may be seen from FIG. 6, be provided with a portion of reduced diameter. With pin 50 in place, the threaded locking member 36 will be screwed into the position shown with the tip of the locking member loosely engaging the reduced diameter portion of pin 50. Thereafter, the desired angular position of blade 16 will be selected, from the options determined by the hole pattern in lower plate 46, and when the appropriate hole in plate 46 is in alignment with either of tubular extensions 30 or 34, a further pin 52 will be dropped in position and thereafter locked in this position by the threaded locking member 38 which engages a reduced diameter portion of pin 52.

As will now be obvious, the plow attachment of the present invention substantially extends the utility of a snow blower since it permits the appliance to be employed, without any time consuming or difficult modification, to remove wet snow and to move small depth snowfalls to safe areas with the piles formed with the plow attachment subsequently beng distributed out of the area being cleared through the use of the snow blower. The plow attachment also permits the clearing of areas where the use of the blower might damage property.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A snow removal appliance, said appliance being adapted for attachment to a snow blower having a blade which rotates about an axis, said appliance comprising:

a frame, said frame having a pair of generally parallel spatially displaced arm means and base means interconnecting first ends of said arm means, said arm means being separated by a distance greater than the width of the rotary blade of a snow blower on which the appliance is to be installed;

means for pivotally connecting the second ends of said frame arm means to a snow blower rearwardly of the axis about which the snow blower rotary blade turns whereby said frame may be pivoted about a generally horizontal axis to place said base means above and rearwardly of the snow blower rotary blade axis or in front of the snow blower rotary blade;

a plow blade;

mounting plate means attached to said frame base means and extending forwardly with respect thereto, said mounting plate means being provided with a plurality of pin receiving sockets;

bracket means, said bracket means being affixed to the rearwardly disposed side of said blade and being provided with a plurality of spaced apertures, said bracket means apertures being positioned so as to be capable of being brought into registration with said mounting plate means sockets in pairs;

first removable pin means for engaging a bracket means aperture and an aligned mounting plate means socket to define a generally vertically oriented pivot connection between said blade and frame base means; and means for fixing said blade in a plurality of different angular positions about said generally vertically oriented pivot connection.

2. The apparatus of claim 1 wherein said means for fixing said blade in a plurality of different angular positions comprises:

second removable pin means for engaging a bracket means aperture and an aligned mounting plate means socket.

3. The apparatus of claim 2 wherein said blade includes:

a receptacle affixed to the side of the blade which faces said frame, said receptacle receiving material for weighting down said blade.

4. The apparatus of claim 2 wherein said means for pivotally connecting the second ends of said arm means to a snow blower comprises:

a pair of shoulder bolts, said shoulder bolts engaging a snow blower at opposite sides of the rotary blade housing thereof.

5. The apparatus of claim 3 wherein said means for pivotally connecting the second ends of said arm means to a snow blower comprises:

a pair of shoulder bolts, said shoulder bolts engaging a snow blower at opposite sides of the rotary blade housing thereof.

6. The apparatus of claim 2 wherein said bracket means comprises:

a pair of spatially displaced plate members, said plate members defining substantially parallel planes and having aligned apertures for engagement by said first removable pin means.

7. The apparatus of claim 6 wherein said mounting plate means socket positioned for engagement by said first pin means is defined by an upwardly extending tubular member, said tubular member and the mounting plate means on which it is supported having a combined length commersurate with the spacing between said bracket means plates.

8. The apparatus of claim 7 wherein said bracket means lower plate is of greater width than said upper plate and wherein the apertures which allow angular adjustment of the blade position are formed in said lower plate only.

* * * * *